US007758324B2

(12) United States Patent
Baumann et al.

(10) Patent No.: US 7,758,324 B2
(45) Date of Patent: Jul. 20, 2010

(54) ROLLER PUMP

(75) Inventors: Manfred Baumann, Schweinfurt (DE); Berthold Breitkopf, Schweinfurt (DE); Elmar Huegel, Hohenroth (DE); Herbert Neubauer, Schweinfurt (DE); Thomas Nuernberger, Burkardroth (DE); Jochen Schneider, Wipfeld (DE); Gerhard Spengler, Euerbach (DE); Ralf Wamsiedler, Goehsheim-Weyer (DE); Wolfgang Biesel, Ottweiler (DE); Christian Busse, Darmstadt (DE); Marco Caronna, Modena (IT); Joerg Jonas, Wehrheim (DE); Reinhold Reiter, Crema (IT); Joern Apel, Saarbruecken (DE); Martin Lauer, St. Wendel (DE)

(73) Assignee: Fresenius Medical Care Deutschland GmbH, Bad Homburg (DE)

( * ) Notice: Subject to any disclaimer, the term of this patent is extended or adjusted under 35 U.S.C. 154(b) by 230 days.

(21) Appl. No.: 11/596,353

(22) PCT Filed: May 12, 2005

(86) PCT No.: PCT/EP2005/005191

§ 371 (c)(1),
(2), (4) Date: Nov. 14, 2006

(87) PCT Pub. No.: WO2005/111424

PCT Pub. Date: Nov. 24, 2005

(65) Prior Publication Data

US 2007/0286756 A1 Dec. 13, 2007

(30) Foreign Application Priority Data

May 14, 2004 (DE) ..... 10 2004 024 102

(51) Int. Cl.
*F04B 43/08* (2006.01)
*F04B 43/12* (2006.01)
*F04B 43/06* (2006.01)

(52) U.S. Cl. ..... 417/477.2; 417/474; 417/476; 417/477.1

(58) Field of Classification Search ..... 417/474–476, 417/477.1–477.14
See application file for complete search history.

(56) References Cited

U.S. PATENT DOCUMENTS

| | | | | |
|---|---|---|---|---|
| 4,545,744 | A | 10/1985 | Weber et al. | |
| 4,631,008 | A * | 12/1986 | Stenner | 417/477.1 |
| 4,674,962 | A | 6/1987 | Gardineer | |
| 5,630,711 | A | 5/1997 | Luedtke et al. | |
| 5,927,956 | A * | 7/1999 | Lim et al. | 417/477.13 |
| 6,164,921 | A * | 12/2000 | Moubayed et al. | 417/44.1 |
| 7,513,757 | B2 * | 4/2009 | Gibson et al. | 417/477.2 |

FOREIGN PATENT DOCUMENTS

| | | |
|---|---|---|
| EP | 0 394 442 A1 | 10/1990 |
| GB | 2 290 582 A | 1/1996 |

* cited by examiner

*Primary Examiner*—Devon Kramer
*Assistant Examiner*—Christopher Bobish
(74) *Attorney, Agent, or Firm*—Jacobson Holman PLLC

(57) ABSTRACT

A roller pump includes a stator with a pump bed formed therein, and a rotor for acting on a hose inserted into the pump bed in arcuate form. The ends of the hose are guided out of the pump bed in a crossed configuration.

20 Claims, 4 Drawing Sheets

ROLLER PUMP

CROSS-REFERENCE TO RELATED APPLICATION

Figure 1:
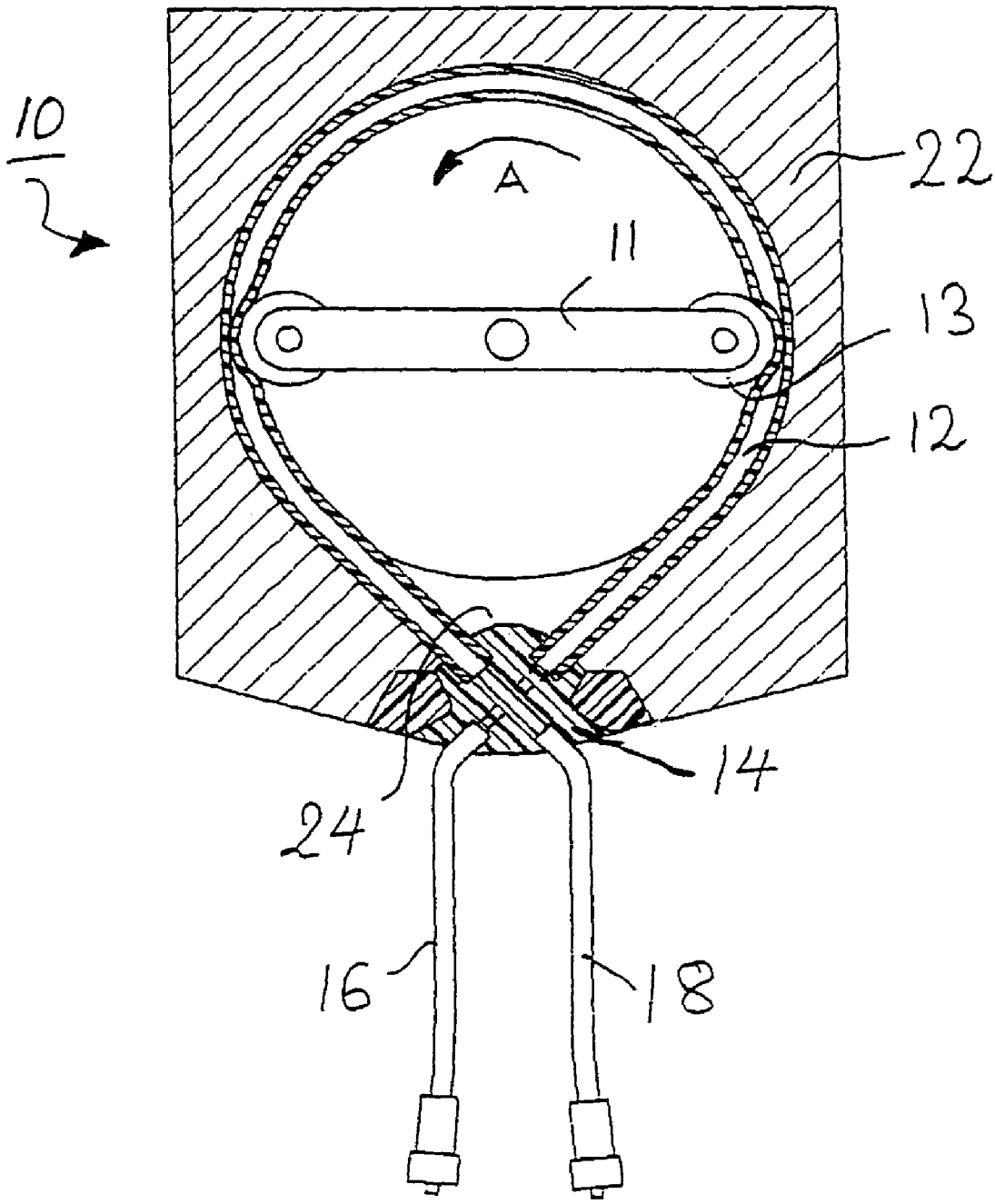

This is a nationalization of PCT/EP05/005191 filed May 12, 2005 and published in German.

BACKGROUND OF THE INVENTION

1. Field of Invention

The invention relates to a roller pump having a stator with a pump bed formed therein and a rotor for acting on a hose inserted into the pump bed in arcuate form.

2. Description of The Prior Art

Roller pumps of this type are known, for example, from U.S. 4,545,744. They consist of a stator with a pump bed formed therein and a rotor for acting on a hose insertable into the pump bed in arcuate form. it is already proposed here to connect the pump hose segment, which is inserted into the pump bed of the roller pump, via a connector to an incoming and an outgoing liquid hose. This connector prevents a slipping of the pump hose segment during the pumping process. At the same time, it is avoided on the basis of an asymmetry in the connector that the pre-assembled hose segment is inserted in a laterally transposed manner. The pump hose segment is preshaped in an arcuate manner by the connector. The incoming and outgoing liquid hose is, in contrast, guided out of the connector in a parallel manner. This has the result that the incoming and outgoing liquid hose in each case requires a great deal of room outside the pump bed in order not to be kinked on a direction-changing hose guidance. A simple bending of the hoses outside the pump bed is not possible since otherwise the liquid flow would be interrupted.

SUMMARY OF THE INVENTION

It is the object of the invention to further develop the generic roller pump such that liquid-conducting hoses can be used in a particularly space-saving manner.

This object is solved in accordance with the invention by the combination of the features described herein. Accordingly, a roller pump consists of a stator having a pump bed formed therein and a rotor for acting on a hose inserted into the pump bed in arcuate form, with the ends of the hose guided out of the pump bed crossing directly after exiting the pump bed. A pump segment thus results in the form of a Greek alpha. The hoses can be guided further in a space-saving manner below or next to the roller pump due to this shape without there being any risk of kinking.

Further particularly preferred embodiment variants of the invention are as described herein.

The hose can advantageously be fixable in the roller pump by a connector. The hose inserted into the roller pump can be guidable through the connector and thus be made as a hose in one piece. Alternatively, however, a separate hose piece insertable into the pump bed and the infeeding and outgoing hose piece can also be connected in the connector.

The connector can advantageously be made as an adapter, with the adapter being insertable in the roller pump in corresponding reception recesses on the basis of its shape. Due to this respective shape matching, a coding can be realized which can also be supported by a corresponding coloring. The reception recesses of the adapter engage laterally into two clip receivers, preferably of different shape. The clipable adapter is matched to the corresponding shape of the clips.

In accordance with another advantageous aspect of the invention, a device, preferably a pimple, is arranged at the adapter and cooperates with a sensor integrated in the roller pump or in the housing forming the roller pump. The sensor confirms the functionally correct insertion of the adapter at the corresponding point.

The adapter particularly advantageously consists of a soft plastic, preferably soft PVC.

The advantages of the hose guidance in accordance with the invention result in a very particularly advantageous manner when the connector is arranged laterally at the pump bed with a horizontal alignment of the rotor axis. An optimum bleeding of the hose segment can be achieved by this arrangement in cooperation with a corresponding direction of rotation of the rotor. It is namely ensured that air which is in the inlet region rises upwardly due to the lifting force. The corresponding pressing rollers of the rotor engage into the hose segment disposed in the pump bed still during the rising and guarantee a compulsory conveying of the corresponding air bubbles. It is similar at the outlet of the hose segment. When the pressing rollers release the hose segment again, the air taken along is already in the rising region of the hose segment. There is thereby no force driving the air back into the pump. These advantages cannot be achieved either with a U-shaped arrangement or with an Ω-shaped arrangement of the hose segment in the pump bed such as were known in the prior art.

To achieve the optimum bleeding, the roller pump has a control unit which sets the corresponding rotary direction of the rotor in dependence on the lateral alignment of the connector. The rotor is thus rotated counterclockwise when the hoses cross on the right hand side and clockwise when the hoses cross on the left hand side.

The hose insertable into the roller pump can also be connected to a connector which is made as an integrated cassette. Finally, the invention also relates to a hose set having a connector such as was previously described as well as a hose to be inserted into the pump bed and connected to the connector.

The invention also relates to a connector which can be inserted into a roller pump in accordance with the invention.

BREIF DESCREPTION OF DRAWINGS

Further features, details and advantages of the invention result from embodiments shown in the drawing.

Figure 2:
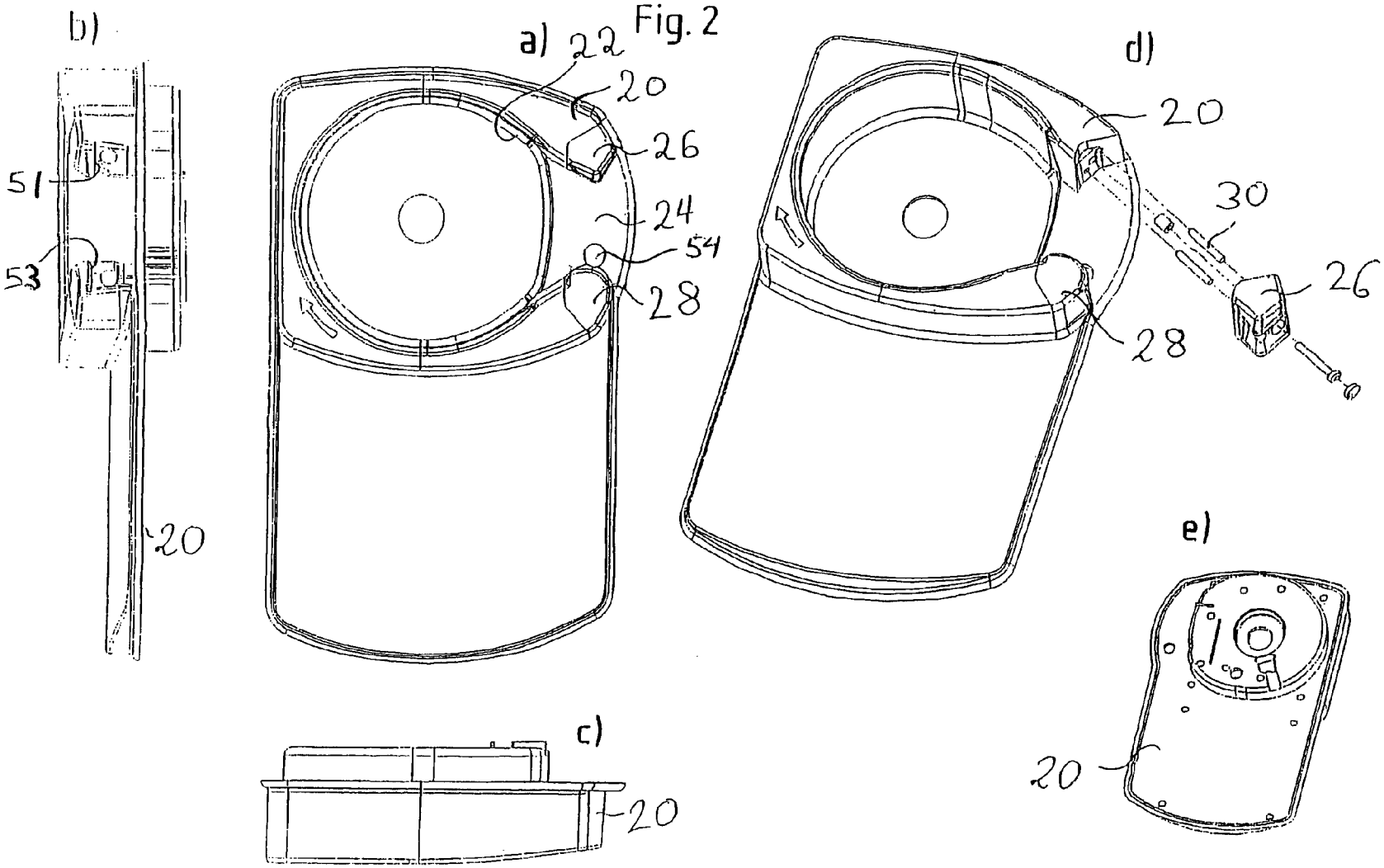
Figure 3:
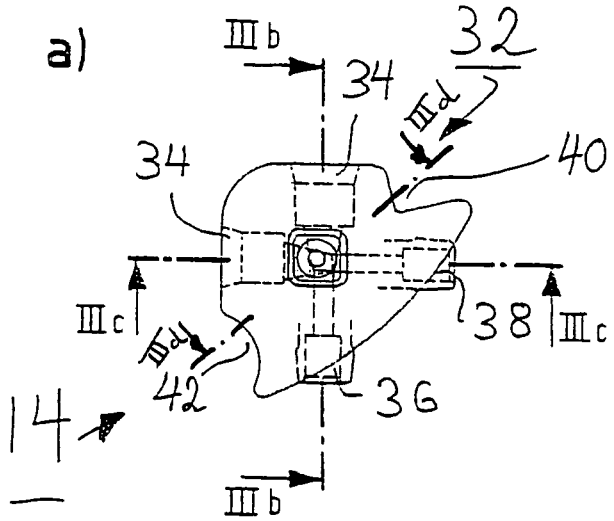
Figure 3:
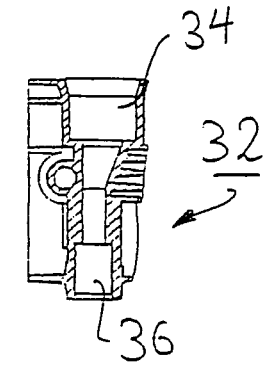
Figure 3:
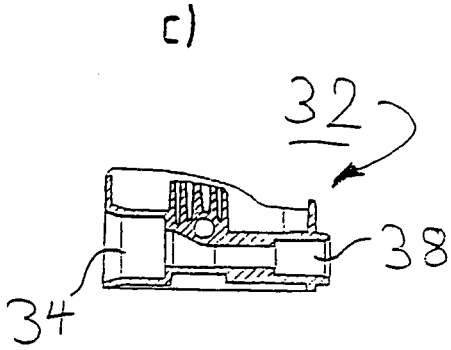
Figure 3:
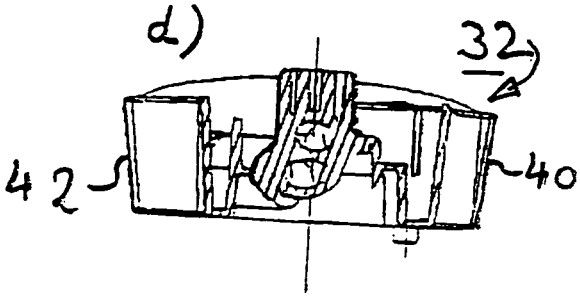
Figure 4:
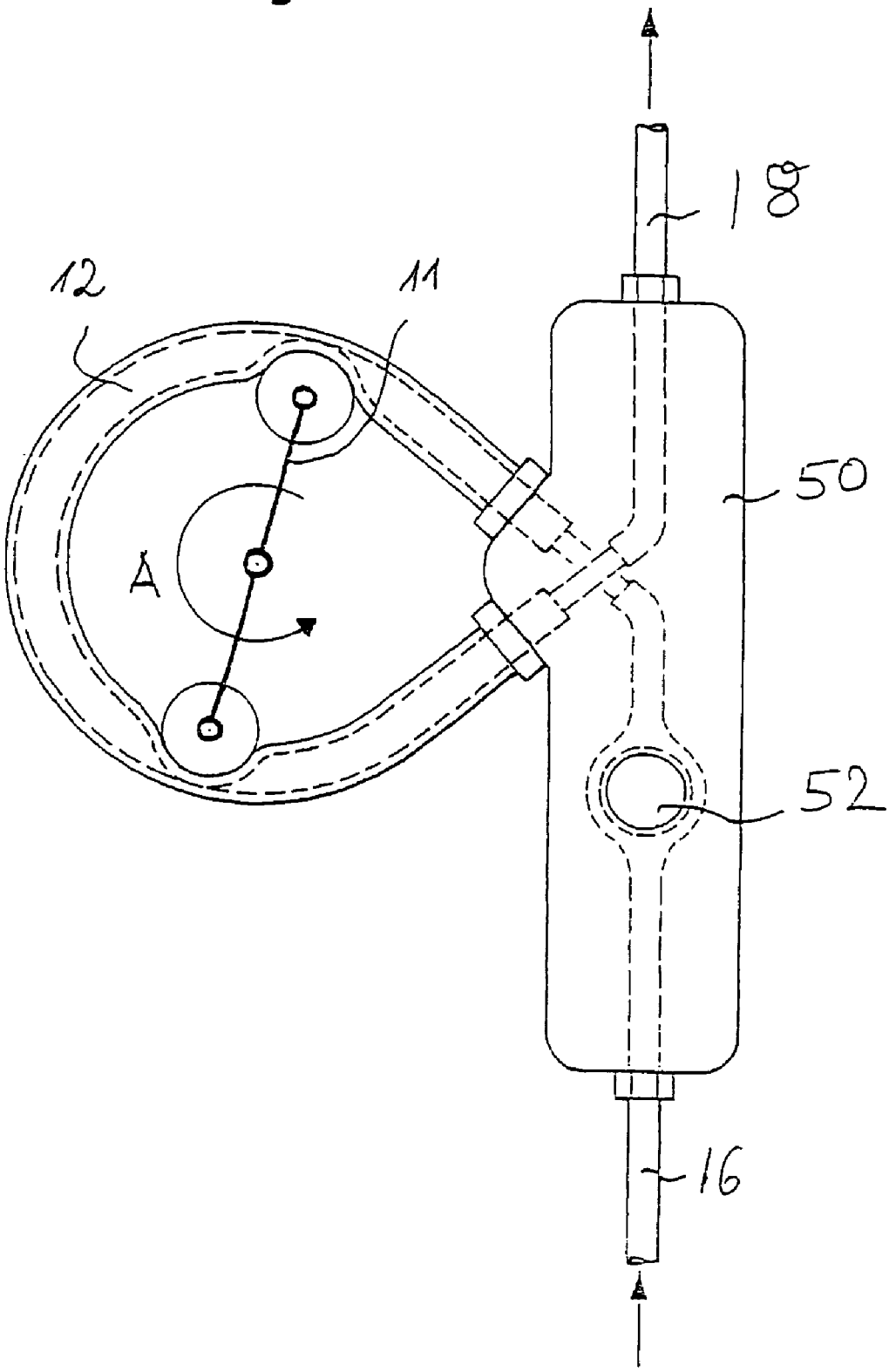

There are shown:

FIG. 1 a schematic view of a roller pump in accordance with a first embodiment of the invention;

FIG. 2: a roller pump housing in different views;

FIG. 3: an adapter piece in different views and sections which can be inserted into the roller pump in accordance with FIG. 2; and FIG. 4: a schematic representation of the hose piece which can be inserted into a roller pump not shown in any more detail here and which is connected to a cassette.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In FIG. 1, a roller pump 10 is shown with a pump bed 22 and an inserted hose 12 which is connected to a connector 14 made as an adapter. An infeeding hose 16 and an outgoing hose 18 are also shown as a hose set at the connector 14. The direction of the arrow indicates the direction of flow of the liquid inside the hose. The ends of the hose guided out of the pump bed cross in the connector 14 in this manner.

The flexible hose 12 is compressed continuously in the direction of the arrow A by a rotor 11 of the roller pump 10 with corresponding rollers 13 so that the corresponding pump effect for the liquid results. A space-saving infeed and outward guidance of the hose 12 or of the hose parts 16 and 18 is possible due to the crossing guidance of the hose 12 resulting from the representation in accordance with FIG. 1 or due to the hose guidance formed by the hose parts 12,16 and 18 and the connector 14 directly next to the opening 24 of the pump bed 22. The hose shape shown in FIG. 1 can be described as an alpha shape in which the ends of the hose 12 guided out of the pump 22 are guided out tangentially and in a crossing manner from the pump bed 22. The hose parts 16 and 18 can also be guided out of the pump directly laterally (not shown).

In FIG. 2, different views of a roller pump housing 20 made as an injection-molded part are shown. Only the stator of the roller pump 10 is shown here. FIG. 2*a*) shows a plan view from above; FIG. 2*b*) a side view; FIG. 2*c*) a view from the front; and FIG. 2*d*) a perspective view from above, whereas FIG. 2*e*) shows a perspective view from below. A pump bed 22 is formed in the roller pump housing 20 and the arcuately shaped hose 12 can be inserted into it in a manner not shown in any more detail here. The pump bed 22 has an opening 24 toward one side. The lateral end regions of the opening 24 are formed by clip receivers 26 and 28 of different shape. As can be seen from FIG. 2*d*), the clip receivers 26 and 28 are separable from the roller pump housing 20. They are fastenable to the housing 20 with corresponding fastening pins 30 and are replaceable. The respective rotor with the corresponding rollers for acting on the hose 12 insertable into the pump bed in arcuate shape is not shown in any more detail here.

FIG. 3*a*) shows a plan view of an adapter piece 32 which can close the opening 24 of the housing 20 in accordance with FIG. 2. In FIG. 3*b*), a corresponding sectional representation in accordance with the line of intersection IIIb-IIIB through FIG. 3*a*) is shown. In FIG. 3*c*), a corresponding sectional representation in accordance with the line of intersection IIIc-IIIc in FIG. 3*a*) is shown. It can first be seen from FIG. 3 that the adapter 32 has corresponding connection regions 36 or 38 for the hoses 16 and 18 and connection regions 34 for the hose 12. When the corresponding hose pieces are connected, they can be clipped into the housing 20 together with the adapter 32, with them being fixed by the corresponding clip receivers 26 and 28. The corresponding recesses 40 and 42 in the adapter 32 are each matched to the shapes of the clip receivers 26 and 28. A specific association of the hose 12 provided with the adapter 32 to a corresponding roller pump 10 can take place here by a corresponding association of the shape of the adapter 32 in the clip receivers 26 and 28. To ensure a simple recognizability for the user here, the adapters 32 can be of different color to allow them to be associated more easily with the respective roller pump 10. A pimple (not shown) is arranged at the lower side of the adapter 14 and cooperates with a sensor integrated in the roller pump to make the proper assembly of the connector or of the correspondingly pre-assembled hose set checkable by the control unit of the roller pump. Such a hose set can include a hose connected to the adapter and to be inserted into the pump bed as well as corresponding hoses leading away from the pump.

FIG. 4 shows a further embodiment of a roller pump 10 in accordance with the invention. Here, only the hose 12 is shown without a roller pump housing. The direction of rotation of the rotor 11 is indicated by the direction of the arrow A. An integrated cassette 50 in which different functional units can be realized is provided as the connector piece here. A pressure measuring device 52 is integrated here by way of example. The ends of the hose guided out of the pump bed also cross in the connector directly next to the rotor region of the pump, i.e. of the opening of the pump bed, in this embodiment.

In the liquid guidance shown here, an optimum bleeding of the hose segment 12 likewise results. Air which lies in the inlet region of the hose 12 rises upwardly due to the lifting force and is compulsorily guided within the rise by the pressure rollers of the rotor along the hose 12. To the extent they arrive at the end region of the hose 12 (viewed in the direction of the arrow A), the air taken along is likewise located in the rising region of the hose 12 so that they rise further and are carried out through the hose 18. This advantageous bleeding results when the crossing part of the hose is arranged on the right hand side and the rotor 11 simultaneously turns counterclockwise. Alternatively, the advantageous bleeding results for the case that the crossing part of the hose is on the left hand side when the rotor turns clockwise.

Generally, the structure in accordance with the invention of the roller pump also permits a more flexible and space-saving design of the fluid guidance with an integrated cassette.

As previously stated, the adapter 32 can be clipped into the housing 20. As in particular results from FIG. 2*b*), the clip receivers 26 and 28 have nose-like projections 51, 53 at the upper end. When the adapter 32 is inserted, it moves beneath these projections, which represents the actual clipping function. The right hand projection 51 forming one side of the clip receiver protrudes further over the margin of the recess of the inserted adapter than the projection 53 on the left hand side (e.g. approximately 1 mm versus some 10 ths mm). On the left hand side, the shape 42 of the adapter piece (cf. FIG. 3) is roundish (approximated to an arc of a circle here), whereas it is angled at the right hand side (reference symbol 40 in FIG. 3). This special geometric coding results in the advantage that the adapter 32 can be released more easily on the round side than on the angled side on the removal from the housing 20. This is now ensured, on the one hand, by the different overlap of the projections 51, 53 (on the part of the housing 20) and, on the other hand, via the better resilience of the round side 42 over the angled side 40 (on the part of the adapter).

The ejection of the adapter takes place via a pin 54 (cf. FIG. 2). The pin is made close to the round clip receiver 28 such that, on the corresponding actuation of the pin 54, the adapter 34 is initially separated from the housing on the round contact side. The corresponding pin 54 can be moved out in a controlled manner not shown in any more detail here by the pump-side housing so that the round side 42 of the adapter 32 snaps out of the clip receiver.

A type of key/lock principle results by the design of the round recess 42, on the one hand, in connection with the round projection 53 of the housing and the angled recess 40 in connection with the angled projection 51 of the housing, for which protection is claimed separately.

The tilt movement generated by the arrangement of the pin 54 on the ejection of the adapter has yet another advantage. The roller pump 10 is equipped with two radial pins such as is also described in U.S. Pat. No. 4,545,744. The two pins are attached on mutually oppositely disposed sides. When the left hand side of the adapter 32 is raised and the right hand side of the adapter 32 is not raised, the lower pin can move easily beneath the hose in the clockwise direction in order to raise this, whereas the upper pin can first extend without problem over the still inserted hose. With a simultaneous raising of both pins, a pin can catch in the pump hose system. This is prevented by the tilt movement on the ejection of the adapter 32.

The adapter 32 is made such that it permits a cant-free connection between the pump hose segment 12 and the outer segments 16, 18 which, as can be seen, for example in FIG. 1, have different inner diameters. This can also be recognized in FIGS. 3*b* and 3*c* in which the openings 34 have a first width and the openings 36 and 38 have a second, smaller width. A transition region directly adjoins this opening. The openings of the transition region correspond to the inner diameters of the hose segments to be inserted. The transition region is characterized in accordance with the invention by a constant transition of the inner diameter to achieve a homogeneous flow which is as blood-compatible as possible.

Furthermore, the crossing region of the two hose segments 16 and 18 is already disposed in a region in which the inner diameters of the two lines are substantially reduced. In accordance with the invention, this permits an alignment of the total pump loop which is as good and smooth as possible so that there is no excessive wear due to the hose guidance pins.

The pin 54 in accordance with FIG. 2*a*) can simultaneously serve as a sensor for a pimple provided at the adapter 32. The pin 54 is here displaced vertically in a manner not shown in any more detail by pressing in the pimple, which can be recognized by a light barrier likewise not shown in any more detail here.

It can be recognized in the section IIId-IIId, as it is shown in FIG. 3*d*, that the spacing at the round recess 42 and at the angled recess 40 of the adapter 32 reduces from top to bottom. This permits a better mold removability of the adapter in the manufacture.

A second projection, not shown in the Figures, which acts as an abutment for the tilting adapter 32 can be provided at the left hand clip receiver 28.

The geometrical associations not shown in this embodiment with respect to the left hand side and the right hand side—namely those of the shape of the clip receivers, those of the projections 51, 53, and also the arrangement of the pin 54, as well as of the second projection—can be swapped as required.

It can be seen from FIG. 1 that the lines continuing the hose segments 16 and 18 cross at right angles in the adapter.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A roller pump comprising:

a stator, a pump bed formed in the stator, and a rotor for acting on a hose inserted into the pump bed in arcuate form;

an insertable and ejectable connector that fixes the hose in the pump, the connector having a rounded recess on a first side thereof and an angled recess on a second side thereof; and a housing for receiving the connector, the housing having a shape that corresponds to a shape of the connector such that the connector is receivable in the housing, and having a first and a second clip receiver attached to opposed sides of the housing, each of the first and second clip receivers being configured to releasably engage the connector, the first clip receiver having a rounded portion configured to receive the rounded recess of the connector, and the second clip receiver having an angled portion configured to receive the angled recess of the connector.

2. The roller pump in accordance with claim 1, wherein ends of the hose that extend out of the pump bed cross each other.

3. The roller pump in accordance with claim 1, wherein the connector is configured as an adapter.

4. The roller pump in accordance with claim 1, wherein a hose piece that is insertable into the pump bed, an infeeding hose, and an outgoing hose are connected to the connector.

5. The roller pump in accordance with claim 1, wherein an upper end of each of the clip receivers has nose-like projections.

6. The roller pump in accordance with claim 1, further comprising in the housing a pin for ejection of the connector.

7. The roller pump in accordance with claim 1, further comprising a device arranged at the connector that cooperates with a sensor integrated in the roller pump.

8. The roller pump in accordance with claim 1, wherein the connector has a soft plastic construction.

9. The roller pump in accordance with claim 1, wherein the connector is arranged laterally at the pump bed with a horizontal alignment of an axle of the rotor.

10. The roller pump in accordance with claim 9, further comprising a control unit which sets a direction of rotation of the rotor clockwise with an opening of the pump bed on a left side and counterclockwise with an opening on a right side.

11. The roller pump in accordance with claim 1, wherein the connector is configured as an integrated cassette.

12. The roller pump in accordance with claim 1, wherein hose segments of different diameter can be inserted in the connector, with a transition region being arranged between the hose segments within the connector which provides a constant transition between two connectors of different inner diameter.

13. The roller pump in accordance with claim 1, wherein segments of the hose cross at right angles in the connector.

14. An assembly comprising a connector and a roller pump in accordance with claim 1, the connector fixing the hose in the pump and having a shape that matingly corresponds to a shape of the first clip receiver and a shape of the second clip receiver.

15. A hose set comprising a connector in accordance with claim 14 and hose segments that are insertable into the pump bed and connected to the connector.

16. The hose set in accordance with claim 15, wherein the connector and the hose segments are connected to one another in a firmly bonded manner.

17. The roller pump according to claim 8, wherein the plastic is PVC.

18. The hose set according to claim 16, wherein the connector and the hose segments are adhesively bonded or welded.

19. A roller pump comprising:

a stator, a pump bed provided in the stator, and a rotor for acting on a hose inserted into the pump bed in arcuate form;

an insertable and ejectable connector that secures the hose in the pump, the connector (i) being configured such that a transition region extending from an inlet portion of the hose and an outlet portion of the hose crosses at right angles in the connector and (ii) having a rounded recess on a first side thereof and an angled recess on a second side thereof; and a housing for receiving the connector, the housing having a shape that corresponds to a shape of the connector such that the connector is receivable in the housing, and having a first and a second attachable clip receiver attached to opposed sides of the housing, each of the first and second clip receivers being configured to releasably engage the connector, the first clip receiver including a rounded portion configured to receive the rounded recess of the connector, and the second clip receiver including an angled portion configured to receive the angled recess of the connector, the first side of the connector that has the rounded recess being ejectable from the housing before the second side of the connector that has the angled recess.

20. The roller pump according to claim 19, wherein the first and the second clip receivers are separable from the housing, and the connector is separable from the first and the second clip receivers.

* * * * *

UNITED STATES PATENT AND TRADEMARK OFFICE

CERTIFICATE OF CORRECTION

PATENT NO. : 7,758,324 B2
APPLICATION NO. : 11/596353
DATED : July 20, 2010
INVENTOR(S) : Baumann et al.

It is certified that error appears in the above-identified patent and that said Letters Patent is hereby corrected as shown below:

In column 1, line 20, please change "it is already proposed" to --It is already proposed--.

In column 2, line 41, please change the heading "BREIF DESCREPTION OF DRAWINGS" to --BRIEF DESCRIPTION OF THE DRAWINGS--.

Signed and Sealed this
Twenty-eighth Day of June, 2011

David J. Kappos

David J. Kappos
*Director of the United States Patent and Trademark Office*